US012240026B2

(12) United States Patent
Coquet et al.

(10) Patent No.: US 12,240,026 B2
(45) Date of Patent: Mar. 4, 2025

(54) COMPACT DEVICE FOR CRIMPING EDGES OF METAL SHEETS, ASSOCIATED CRIMPING UNIT AND METHOD

(71) Applicant: STELLANTIS AUTO SAS, Poissy (FR)

(72) Inventors: Jean Marie Coquet, Beaucourt (FR); Laurent Henane, Chennevieres sur Marne (FR)

( * ) Notice: Subject to any disclaimer, the term of this patent is extended or adjusted under 35 U.S.C. 154(b) by 0 days.

(21) Appl. No.: 18/686,322

(22) PCT Filed: Sep. 2, 2022

(86) PCT No.: PCT/FR2022/051656
§ 371 (c)(1),
(2) Date: Feb. 23, 2024

(87) PCT Pub. No.: WO2023/052700
PCT Pub. Date: Apr. 6, 2023

(65) Prior Publication Data

US 2024/0261844 A1 Aug. 8, 2024

(30) Foreign Application Priority Data

Sep. 29, 2021 (FR) ..... 2110249

(51) Int. Cl.
*B21D 39/02* (2006.01)

(52) U.S. Cl.
CPC ..... *B21D 39/021* (2013.01)

(58) Field of Classification Search
CPC ..... B21D 39/021; B21D 39/02; B21D 53/88
(Continued)

(56) References Cited

U.S. PATENT DOCUMENTS 5,050,422 A * 9/1991 Dorsett ..... B21D 39/021 29/243.58
2007/0193325 A1 8/2007 Matsumoto

FOREIGN PATENT DOCUMENTS

FR 3089831 A1 6/2020
JP S4868459 A 9/1973
(Continued)

OTHER PUBLICATIONS

International Search Report to corresponding PCT/FR2022/051656 mailed Nov. 16, 2022.
(Continued)

*Primary Examiner* — Christopher L Templeton
*Assistant Examiner* — P Derek Pressley
(74) *Attorney, Agent, or Firm* — Sandberg Phoenix & von Gontard, PC; Jonathan P. Soifer

(57) ABSTRACT

The present invention relates to a device (20) for crimping edges of metal sheets by folding one of said edges onto another one of said edges. The crimping device comprises a support member (22), and a blade holder (24) movable relative to the support member and carrying at least one crimping blade (26). The crimping device is characterized in that it further comprises an intermediate support member (28) pivotably mounted on the support member, in that the blade holder is mounted so as to be translatable on the intermediate support member and in that an actuator (30) comprising a cylinder (25) connected to the blade holder and a sliding rod provided with a spherical distal end facing the crimping blade and configured to engage with a bearing part on a spherical distal die (12) facing the crimping blade and configured to engage with a bearing part on a die (12) for receiving the edges of metal sheets.

11 Claims, 3 Drawing Sheets

(58) Field of Classification Search
USPC ..... 29/243.57, 243.58; 72/312, 314, 319, 72/320, 321, 322, 323
See application file for complete search history.

(56) References Cited

FOREIGN PATENT DOCUMENTS

| | | | | |
|---|---|---|---|---|
| JP | 2003094126 | A | * | 4/2003 |
| JP | 2005028368 | A | * | 2/2005 |
| WO | 2001068285 | A1 | | 9/2001 |

OTHER PUBLICATIONS

Written Opinion to corresponding PCT/FR2022/051656 mailed Nov. 16, 2022.

* cited by examiner

[Fig. 1]
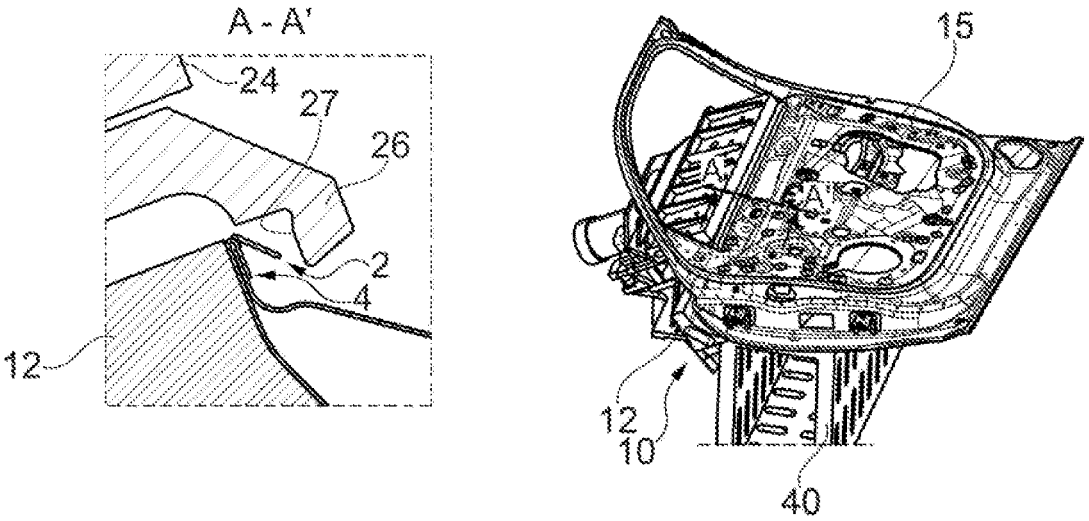
[Fig. 2]
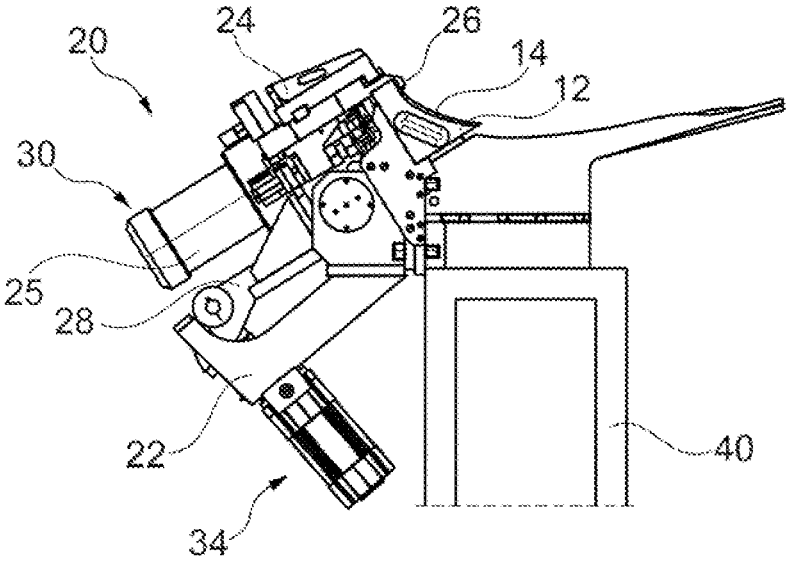

[Fig. 3]
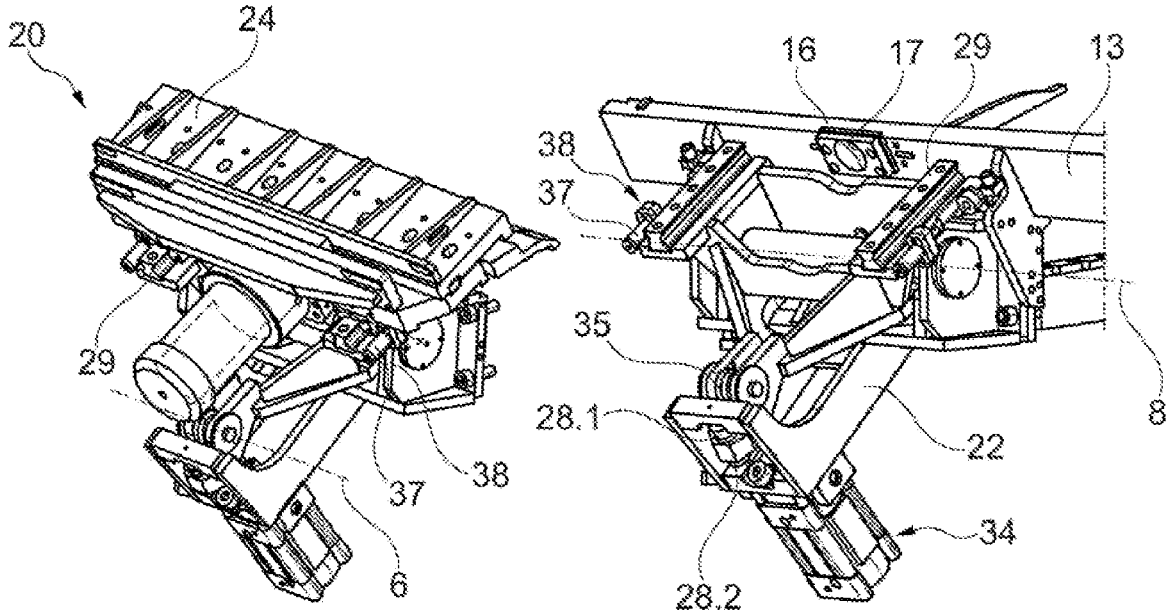
[Fig. 4]
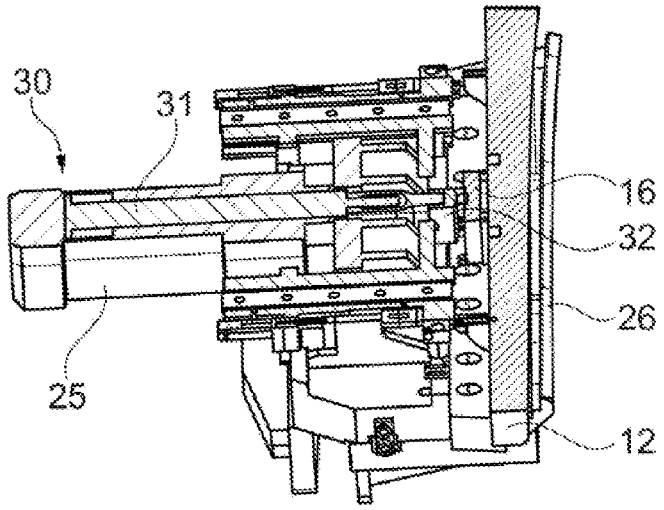

[Fig 5]
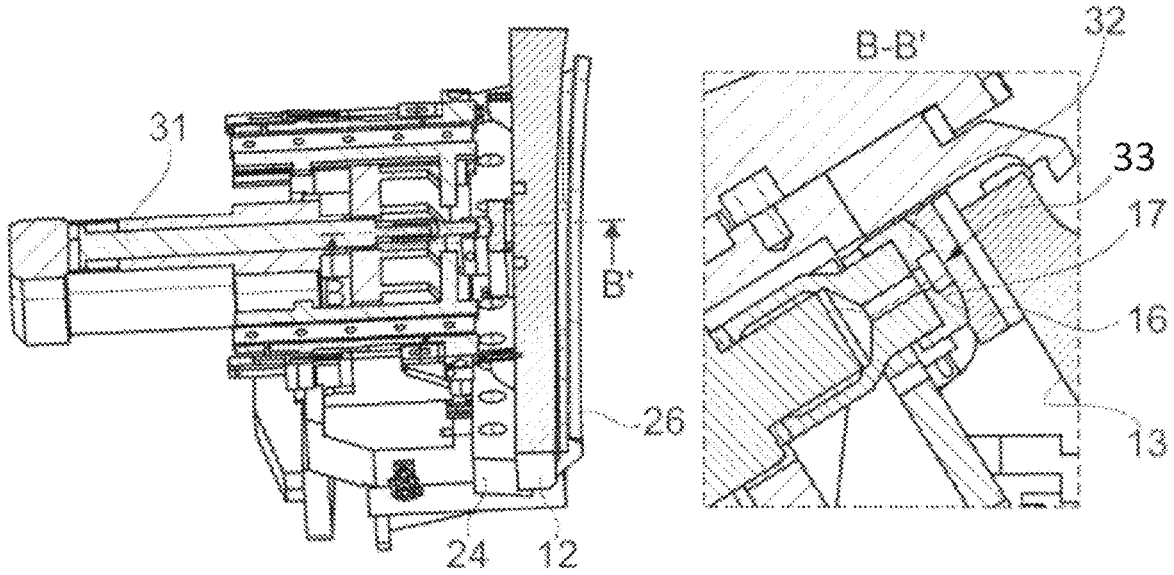
[Fig 6]
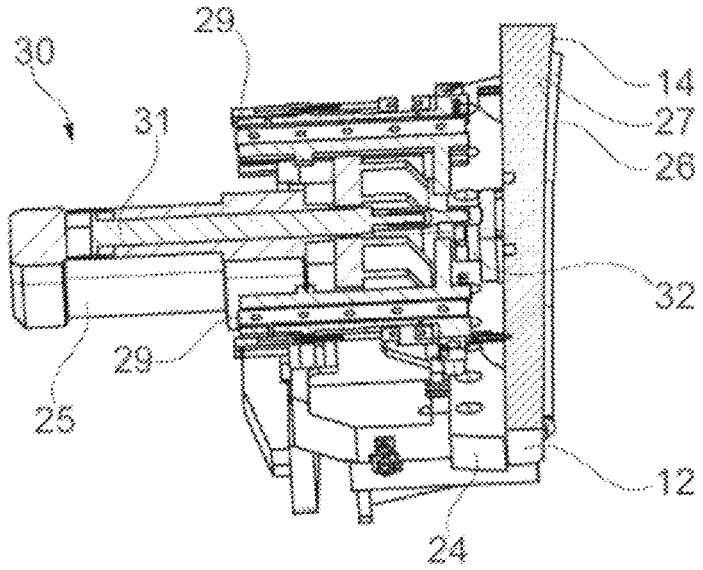

COMPACT DEVICE FOR CRIMPING EDGES OF METAL SHEETS, ASSOCIATED CRIMPING UNIT AND METHOD

CROSS-REFERENCE TO RELATED APPLICATIONS

This application is the US National Stage under 35 USC § 371 of International Application No. PCT/FR2022/051656, filed Sep. 2, 2022, which claims the priority of French application 2110249 filed on Sep. 29, 2021, the content (text, drawings and claims) of both said applications being incorporated by reference herein.

The methods and devices of the present application relate to the field of assembling bodywork elements of motor vehicles by folding their edges.

The methods and devices relate in particular to the crimping of opening panel window bottoms or of sunroofs of motor vehicles.

BACKGROUND

Crimping is a cold assembly technique, based on folding metal sheets, used in particular in the automobile industry for shaping bodywork elements such as opening panels, fenders, wheel arches or hoods. It constitutes a major step in the vehicle manufacturing process, since it generally completes the assembly of exterior bodywork elements that are directly exposed to the view of the customer and/or user.

The crimping of motor vehicle opening panels is generally carried out either by robots using a wheel or by mechanical crimping units.

Wheel crimping is carried out using a programmable robot equipped with a crimping wheel moving along the edge of the bodywork element to be assembled. The main disadvantage of this type of crimping is its low rate due, in particular, to the need to perform several passes to complete the assembly. However, current manufacturing needs require reduced production cycle times.

Another disadvantage of these robots is their bulk, which limits the space in the assembly area. Indeed, in order to reduce production cycle times, it is conventional to increase the number of robots used. However, the quantity of robots is limited by their dimensions, and by their accessibility with regard to the perimeter to be crimped. Indeed, certain areas of the bodywork elements to be assembled are not accessible or are difficult to access by robotic arms. This type of problem can be encountered, for example, at the bottom of the opening panel window.

To solve this problem, it is common to use open table crimping. However, the use of this type of crimper implies the presence, on the latter, of a die and blades specific to the crimping of a very particular type of opening panel. Therefore, the main disadvantage of this method is its lack of flexibility, since only one type of bodywork element can be crimped. This is incompatible with current manufacturing needs, which require increased versatility.

Likewise, in order to improve versatility, crimping tools are generally carried on moving platforms. However, open table crimping generates significant masses and bulk that are incompatible with the movements of the mobile platforms.

These same problems are found with current crimping units whose mass and size are significant, which does not allow them to be installed on rotating plates. In addition, these units have a high cost.

Published patent document FR 3 089 831 A1 discloses a crimping unit for crimping the bottom of the opening panel window of a motor vehicle. However, this unit is heavy and bulky. In addition, the forces applied by this type of machine, i.e. motor or electric cylinder operating a connecting rod-crank system, during the crimping phase, are taken up by the crimping die and by its support member; moreover, said connecting rod-crank system has limits due to the absence of guidance, which requires significant sizing.

SUMMARY

One aim is in particular to correct all or part of the drawbacks of the prior art by proposing a solution making it possible to reduce the dimensioning of the crimping unit.

To this end, the described methods and devices relate to a device for crimping edges of metal sheets by folding one of said edges onto another one of said edges, comprising:

- a support member;
- a blade holder movable relative to the support member and carrying at least one crimping blade;

remarkable in that the crimping device further comprises:

- an intermediate support member pivotably mounted on the support member, the blade holder being mounted so as to be translatable on the intermediate support member;
- an actuator comprising a cylinder connected to the blade holder and a sliding rod provided with a rounded distal end facing the crimping blade and configured to engage with a bearing part on a die for receiving the edges of metal sheets.

According to one embodiment, the mounting of the blade holder so as to be translatable on the intermediate support member is parallel to the sliding rod of the actuator.

According to one embodiment, the mounting of the blade holder so as to be translatable on the intermediate support member comprises at least two slide rails, each with a dovetail section.

According to one embodiment, the crimping device further comprises at least one spring cylinder attached to the intermediate support member and exerting an elastic force on the blade holder in the direction of translation. Advantageously, the at least one spring cylinder is a gas spring.

According to one embodiment, each of the spring cylinders comprises a cylinder rigidly attached to the intermediate support member and a sliding rod in contact with the blade holder.

According to one embodiment, the crimping device is configured so that the crimping blade moves relative to the intermediate support member, toward the rounded distal end of the sliding rod of the actuator, during a movement of the blade holder in order to crimp the metal sheet edges.

The describerd methods and devices also relate to a unit for crimping metal sheet edges by folding one of said edges onto another one of said edges, comprising:

- a die with a face for receiving the metal sheet edges;
- a device for crimping the metal sheet edges against the die; the crimping unit being remarkable in that the crimping device is.

According to one embodiment, the die has a rear face opposite the receiving face and that receives the bearing part, the rounded distal end of the sliding rod of the actuator coming against said bearing part during crimping of the edges of metal sheets.

Another object is a method for crimping the edges of metal sheets by folding one of said edges onto another of said edges, said method being remarkable in that it is implemented by a crimping unit and in that it comprises:

- a pivoting action of the intermediate support member; and a sliding action of the blade holder relative to the intermediate support member.

According to one embodiment of the method, the pivoting action of the intermediate support member causes the crimping blade to enter a window well of a motor vehicle opening panel and the sliding action of the blade holder relative to the intermediate support member forms a window bottom of said opening panel.

BRIEF DESCRIPTION OF THE DRAWINGS

FIG. 1 depicts the crimping of a vehicle opening panel window bottom using a unit for crimping edges of metal sheets.

FIG. 2 is a side view of the crimping unit of FIG. 1.

FIG. 3 depicts two perspective views of the crimping device of the crimping unit of FIGS. 1 and 2.

FIG. 4 is a cross sectional view of the crimping unit in a first crimping step.

FIG. 5 corresponds to FIG. 4 in a later step.

FIG. 6 corresponds to FIG. 5 in a later step.

DETAILED DESCRIPTION

The right part of FIG. 1 illustrates the crimping of a motor vehicle opening panel window bottom using a crimping unit 10. The opening panel, in this case a vehicle door, comprises an opening intended to receive a window.

The left part of FIG. 1 is a cross sectional view of the right part of FIG. 1 along cross section A-A'.

With reference to the left part of FIG. 1, the operation of crimping an opening panel window bottom consists in folding one open edge of a metal sheet flat toward another edge of a metal sheet by inserting a crimping blade 26 in the window well of the opening panel. The crimping is carried out against a receiving face, for receiving the edges of metal sheets, of a fixed die 12 of the crimping unit 10, using a blade holder 24.

According to one embodiment, the crimping operation is carried out after an operation of pre-crimping the metal sheet edge intended to be folded against the other metal sheet edge. During the operation of pre-crimping the metal sheet edge, said metal sheet edge is partially folded toward the other metal sheet edge.

The cross sectional view A-A' of FIG. 1 depicts the metal sheet edge 2 intended to be folded before the crimping operation thereof and after the crimping thereof on the other sheet edge 4. In this embodiment, a pre-crimping operation has previously been carried out so that the angle formed by the sheet edge after pre-crimping and the sheet edge against which the pre-crimped sheet edge will be folded has a predetermined value. For example, the predetermined value of the angle is equal to 45°.

According to one embodiment, the crimping unit 10 is attached to a frame 40 intended to receive bodywork elements 15 made of metal sheets whose edges are to be crimped.

The crimping unit 10 for crimping the metal sheet edges by folding one of said edges onto another of said edges comprises the die 12 and a crimping device 20. The crimping operation is carried out by the crimping device 20 against the die 12.

The face receiving the metal sheet edges is intended to cooperate with a working face 27 of the crimping blade 26 during the crimping operation. During this operation, the metal sheet edge is pressed against the other metal sheet edge between the receiving face 14 for receiving the metal sheet edges of the die 12 and the working face 27 of the crimping blade 26.

The crimping unit 10 can be used to crimp a relatively linear area, such as for example a sunroof or the bottom of a motor vehicle opening panel window.

With reference to FIGS. 2 and 3, the device 20 for crimping the edges of metal sheets by folding one of said edges onto another of said edges comprises a support member 22, a blade holder 24 movable relative to the support member 22 and carrying at least a crimping blade 26.

According to one embodiment, the support member 22 is intended to attach the crimping device 20, for example, to a frame 40 arranged in particular to receive bodywork elements 15 whose edges are to be crimped. The attachment can be carried out by means of screws, which makes it possible to dismantle the crimping device 20 from the frame 40.

An intermediate support member 28 is pivotably mounted on the support member 22 to pivot about an axle 8, the pivoting of the intermediate support member 28 being achieved by means of the pivoting cylinder 34. A distal part 35 of the rod of the cylinder 34 is articulated on an axle 6 of the intermediate support member 28, with stops 28.1 and 28.2 belonging to said intermediate support member 28 respectively ensure the repeatability of the high and low positions of said intermediate support member 28.

The blade holder 24 is mounted so as to be movable in translation on the intermediate support member 28, said mounting comprising at least two slide rails 29 each with a dovetail section.

With reference to FIG. 4, the crimping device 20 comprises an actuator 30 comprising a cylinder 25 linked to the blade holder 24 and a sliding rod 31 provided with a rounded distal end 32 facing the crimping blade 26 and configured to engage with a bearing part 16 on a die 12 for receiving the edges of metal sheets.

According to one embodiment, the mounting of the blade holder 24 so as to be translatable on the intermediate support member 28 is parallel to the sliding rod 31 of the actuator 30.

According to one embodiment, the crimping device 20 further comprises at least one spring cylinder 38 attached to the intermediate support member 28 and exerting an elastic force on the blade holder 24 in the direction of translation; said spring cylinder 38 may be of several types and is preferentially a gas cylinder.

To this end, each of the spring cylinders 38 comprises a cylinder 37 rigidly attached to the intermediate support member 28 and a sliding rod 31 in contact with the blade holder 24.

According to one embodiment, the crimping device 20 is configured so that the crimping blade 26 moves relative to the intermediate support member 28, toward the rounded distal end 32 of the sliding rod 31 of the actuator 30, during a movement of the blade holder 24 in order to crimp the edges of metal sheets.

In order to allow the loading of the metal sheet edges on the die 14, the intermediate support member 28 is in the low position, i.e. the rod of the pivoting cylinder 34 is retracted and the stop 28.2 is in direct contact with the support member 22, the rod 31 of the actuator 30 is retracted.

At the same time, at least one of the pre-stressed spring cylinders 38 exerts an elastic force on the blade holder 24; said spring cylinders 38 ensure contact of the stops 36 belonging to the blade holder 24 with the intermediate support member 28.

In this configuration, the spring cylinders 38 exert a sufficient force to overcome the gravity of the assembly formed by the blade holder 24 and the intermediate support member 28 which, naturally, would be placed in a low position relative to the intermediate support member 28.

According to one embodiment, the first movement of the crimping device 20 is a tilting of the intermediate support member 28 about an axis of rotation 8 common with the support member 22, said tilting is actuated by the projection of the rod of the cylinder 34, the stop 28.1 is then in the high position in contact with the support member 22.

This allows the crimping blade 26 to be above the metal sheet edge to be crimped and its working face 27 to be facing the metal sheet edge to be crimped; the crimping blade 26 is considered to be in a deployed position before crimping.

In the context of crimping the bottom of an opening panel window, the pivoting of the intermediate support member 28 about its axis of rotation 8 makes it possible to bring the crimping blade 26 into (or out of) the window well of the opening panel in the pivoting direction.

The rounded distal end 32 comprises a crimping force absorbing face 33, said crimping force absorbing face 33 faces the rear face 17 belonging to the bearing part 16 of the die 12 without these two faces 33, 17 being in contact.

FIG. 5 shows a configuration of the crimping unit 10 just before the crimping action. The sliding rod 31 advances until it positions its rounded distal end 32 against the bearing part 16; the crimping force absorbing face 33 is then in direct contact with the rear face 17.

The height of the position of the bearing part 16 is adjustable by means, for example, of a sliding attachment system mounted on the rear face 13. Advantageously, the rounded contact between the crimping force absorbing face 33 and the rear face 17, combined with the possibility of adjusting the height of the position of the bearing part 16, makes it possible to ensure good bearing between the rounded distal end 32 and said bearing part 16, which helps to limit the forces in the surrounding parts and overcome a possible problem of parallelism between the bearing part 16 and the distal end 32 in the case where their respective faces 17, 33 would have been flat.

The rounded contact between the crimping force absorbing face 33 and the rear face 17 is shown in cross sectional view B-B' of FIG. 5.

With reference to FIG. 5, the spring cylinders 38 always maintain the elastic force exerted on the blade holder 24. At the same time, the crimping blade 26 is held relative to the die 12 in the same position as before.

FIG. 6 shows the crimping unit 10 during the crimping operation. Pressure is applied inside the actuator 30 in order to cause its sliding rod 31 to extend from the cylinder 25. Since the actuator 30 is arranged on the blade holder 24 and on the slide rails 29, the projection of its rod generates a relative movement between the blade holder 24 and the slide rails 29.

Since the crimping force absorbing face 33 of the rounded distal end 32 is in contact with the rear face 17 of the bearing part 16, the rod 31 of the actuator 30 can no longer advance, but it continues to extend from the cylinder 25 of the actuator 30. Thus, it is the blade holder 24 which slides on the intermediate support member 28, reducing the space between the crimping blade 26 and the die 12. The blade holder 24 leaves its deployed position. The metal sheet edges are then folded between the working face 27 of the crimping blade 26 and the receiving face 14 of the die 12 for receiving the metal sheet edges. The crimping of metal sheet edges is carried out by a relative movement between the rod of the actuator 30 and its cylinder 25.

During the crimping operation, it can be noted that the direction of the force exerted by the actuator 30 on its sliding rod 31 is reversed compared to the situations previously described.

By analyzing the chain of forces, we notice that they are closed in a "C" loop, without passing through the support members of the crimping unit 10 or through the frame 40 supporting the die 12 and the bodywork elements 15 whose edges are to be crimped. Advantageously, the absorption of crimping force at the rear face 17 of the C-shaped bearing part 16 makes it possible to limit the deformations of the crimping unit 10.

The method of crimping the metal sheet edges by folding one of said edges onto another of said edges therefore comprises a pivoting action of the intermediate support member 28 and a sliding action of the blade holder 24 relative to the intermediate support member 28 in order to press the metal sheet edges against one another.

Advantageously, the construction of the crimping device 20, with simple pivoting and translation movements, makes it possible to reduce the mass and size of the unit 10 for crimping metal sheet edges compared to the existing units. In fact, the folding force is ensured by pure translation, which can easily be achieved by a cylinder. It is therefore no longer necessary to use a motor driving a complicated connecting rod and crank system. This simplification of the mechanical parts also makes it possible to reduce the cost of the crimping unit.

Advantageously, working with an action/reaction system makes it possible to limit the forces in the surrounding parts and ensures the rigidity of the crimping unit despite its small size.

The invention claimed is:

1. A device for crimping edges of metal sheets by folding one of said edges onto another one of said edges, comprising:

a support member;

an intermediate support member pivotably mounted on the support member to pivot about an axle extending generally transversely to the support member, a blade holder carrying at least one crimping blade, the blade holder being mounted to the intermediate support member so as to be translatable along the intermediate support member;

a pivot cylinder operably connected to said intermediate support member to pivot said intermediate support member relative to said support member about said axle when activated, whereby the intermediate support member is pivotable between a low position and a tilted high position: and an actuator comprising a cylinder linked to the blade holder and a sliding rod comprising a rounded distal end facing the crimping blade, said sliding rod being movable in a direction generally perpendicular to said axle, said rounded distal end configured to engage with a bearing part on a die for receiving the metal sheet edges.

2. The crimping device according to claim 1, wherein the mounting of the blade holder so as to be translatable on the intermediate support member is parallel to the sliding rod of the actuator.

3. The crimping device according to claim 1, wherein the intermediate support member comprises at least two slide rails, each with a dovetail section which movably mount the blade holder to the intermediate support member.

4. The crimping device according to claim 1, further comprising at least one spring cylinder attached to the intermediate support member and exerting an elastic force on the blade holder in the direction of translation.

5. The crimping device according to claim 4, wherein each of the spring cylinders comprises a cylinder rigidly attached to the intermediate support member and a sliding rod in contact with the blade holder.

6. The crimping device according to claim 1, wherein said crimping device is configured so that the crimping blade moves relative to the intermediate support member, toward the rounded distal end of the sliding rod of the actuator, during a movement of the blade holder in order to crimp the metal sheet edges.

7. A unit for crimping metal sheet edges by folding one of said edges onto another one of said edges, comprising:

a die with a face for receiving the metal sheet edges;

a device for crimping the metal sheet edges against the die; wherein the crimping device is according to claim 1.

8. The crimping unit according to claim 7, wherein the die has a rear face opposite the receiving face and that receives the bearing part, the rounded distal end of the sliding rod of the actuator coming against said bearing part during crimping of the metal sheet edges.

9. A method for crimping edges of metal sheets by folding one of said edges onto another of said edges, said method being wherein it is implemented by a crimping unit according to claim 7 and in that it comprises a pivoting action of the intermediate support member; and a sliding action of the blade holder relative to the intermediate support member.

10. The method according to claim 9, wherein the pivoting action of the intermediate support member causes the crimping blade to enter a window well of a motor vehicle opening panel and the sliding action of the blade holder relative to the intermediate support member forms a window bottom of said opening panel.

11. A device for crimping edges of metal sheets by folding one of said edges onto another one of said edges, the device comprising:

a support member;

an intermediate support member mounted to said support member to pivot relative to said support member about an axle between a raised position and a lower position;

a blade holder mounted on said intermediate support member so as to be translatable along the intermediate support member, said blade holder comprising at least one crimping blade; the intermediate support member comprising at least two slide rails which movably mount the blade holder to the intermediate support member;

a spring cylinder mounted to the intermediate support member and configured to exert an elastic force on the blade holder in a direction of translation of the blade holder;

a pivot cylinder operably connected to said intermediate support member and operable to pivot said intermediate support member about said axle between a high position and a low position; and an actuator mounted on said intermediate support member, said actuator comprising a cylinder and a sliding rod which is extendable from said cylinder, said sliding rod comprising a rounded distal end facing said at least one crimping blade; wherein activation of the actuator causes the sliding rod to move in a first direction perpendicular to said axle, toward the at least one crimping blade, and to engage with a bearing part on a die for receiving the metal sheet edges to reduce a space between the crimping blade and the die.

* * * * *